US010327476B2

(12) United States Patent
Lin et al.

(10) Patent No.: US 10,327,476 B2
(45) Date of Patent: Jun. 25, 2019

(54) ELECTRONIC CIGARETTE VAPORIZER

(71) Applicant: Guangrong Lin, Shenzhen, Guangdong (CN)

(72) Inventors: Guangrong Lin, Guangdong (CN); Xianbin Zheng, Guangdong (CN); Xindi Hu, Guangdong (CN)

(73) Assignee: Guangrong Lin, Shenzhen (CN)

( * ) Notice: Subject to any disclaimer, the term of this patent is extended or adjusted under 35 U.S.C. 154(b) by 40 days.

(21) Appl. No.: 15/550,386

(22) PCT Filed: Jan. 29, 2016

(86) PCT No.: PCT/CN2016/072827

§ 371 (c)(1),
(2) Date: Aug. 11, 2017

(87) PCT Pub. No.: WO2016/127839

PCT Pub. Date: Aug. 18, 2016

(65) Prior Publication Data

US 2018/0235277 A1 Aug. 23, 2018

(30) Foreign Application Priority Data

Feb. 13, 2015 (CN) ..... 2015 2 0106832 U

(51) Int. Cl.

| | |
|---|---|
| ***A24F 47/00*** | (2006.01) |
| ***A24F 7/02*** | (2006.01) |
| ***H05B 3/46*** | (2006.01) |

(52) U.S. Cl.

CPC ..... *A24F 47/008* (2013.01); *A24F 7/02* (2013.01); *A24F 47/00* (2013.01); *H05B 3/46* (2013.01)

(58) Field of Classification Search

CPC ..... A24F 47/008

See application file for complete search history.

(56) References Cited

U.S. PATENT DOCUMENTS

2013/0192615 A1* 8/2013 Tucker ..... H01C 17/00 131/328
2016/0316820 A1* 11/2016 Liu ..... A24F 47/008

FOREIGN PATENT DOCUMENTS

CN 203121014 U 8/2013

OTHER PUBLICATIONS

International Search Report of PCT Patent Application No. PCT/CN2016/072827 dated Apr. 22, 2016.

* cited by examiner

*Primary Examiner* — Eric Yaary

(57) ABSTRACT

The invention provides an electronic cigarette vaporizer, comprising a housing, a mouthpiece connected with an end of the housing and provided with a vapor channel, and a threaded connecting end sleeve-connected with another end of the housing, wherein the mouthpiece is dismountably connected with an end of the housing, an outer sleeve is closely sleeved in the housing, an inner sleeve is arranged within the outer sleeve, a closed liquid storage chamber for storing cigarette liquid is formed between the outer sleeve, the inner sleeve, the mouthpiece, and the threaded connecting end. The invention has advantages that, when the cigarette liquid is used up and the mouthpiece is dismounted, the chamber body of the liquid storage chamber can be opened to facilitate the replenishment of cigarette liquid and the reuse of the electronic cigarette vaporizer by the user.

10 Claims, 4 Drawing Sheets

ELECTRONIC CIGARETTE VAPORIZER

FIELD OF THE INVENTION

The present invention relates to the field of electronic cigarettes, more particularly to an electronic cigarette vaporizer.

BACKGROUND OF THE INVENTION

Existing tobacco cigarettes contain tobacco tars which are harmful to people's health. As people pay more and more attention to health, they begin to realize the harmful health effects of tobacco. Since e-cigarette liquid does not contain tobacco tars, the e-cigarettes are widely used and gradually replace tobacco cigarettes.

The electronic cigarette usually heats and vaporizes e-cigarette liquid by means of a vaporizer, thereby producing vapor for the smoker. The e-cigarette liquid usually is stored in the vaporizer of the electronic cigarette. When the cigarette liquid is used up, the vaporizer needs to be replaced with a new one or supplemented with more cigarette liquid. However, replacing of new vaporizer easily results in a waste of resources. Furthermore, in order to replenish cigarette liquid, existing electronic cigarette vaporizers usually need special tools, by which the cigarette liquid can be replenished through a connecting end of the vaporizer and the battery. In this case, the connecting end needs to be disconnected, which involves complicated process. Moreover, during the refilling of the cigarette liquid, the cigarette liquid may overflow the inlet structure of existing electronic cigarette vaporizers and flow into the vaporizing chamber.

SUMMARY OF THE INVENTION

Technical Problems

The present invention aims to solve the above-mentioned shortcomings and provide an electronic cigarette vaporizer which can be easily reused in such a way that, when the cigarette liquid is used up, the mouthpiece can be dismounted by the user so as to facilitate the direct filling or instilling of cigarette liquid into the liquid storage chamber of the vaporizer and then can be remounted.

Technical Solutions

In order to solve the technical problems, the present invention provides an electronic cigarette vaporizer, comprising a housing, a mouthpiece connected with an end of the housing and provided with a vapor channel, and a threaded connecting end sleeve-connected with another end of the housing, characterized in that, the mouthpiece is dismountably connected with the end of the housing, an outer sleeve is closely sleeved in the housing, an inner sleeve is arranged within the outer sleeve, a vaporizing tube is arranged within the inner sleeve, and a vapor flow channel and vaporizing chamber is arranged in the vaporizing tube, wherein the vaporizing chamber is in communication with the vapor channel of the mouthpiece, and an absorbent wick and a heating coil wound around a part of the absorbent wick are arranged in the vaporizing chamber, wherein the outer sleeve and the inner sleeve respectively have one end sealingly connected with the mouthpiece and another end sealingly connected with the threaded connecting end, and a closed liquid storage chamber for storing cigarette liquid is formed between the outer sleeve, the inner sleeve, the mouthpiece, and the threaded connecting end.

Preferably, several small holes may be provided on the wall of the inner sleeve, a vaporization separating sleeve may be arranged between the inner sleeve and the vaporizing tube and at an end close to the mouthpiece, and a sealing ring may be arranged at another end. A closed liquid guide path may be formed between the inner sleeve, the vaporizing tube, the vaporization separating sleeve, and the sealing ring. A part of the absorbent wick, which is not wound by the heating coil, at least may have an end extending into the liquid guide path.

Preferably, the vaporization separating sleeve may be cup shaped and may be inversely and sleeve-connected between the inner sleeve and the vaporizing tube, and may be provided with a vapor through hole arranged at the cup bottom.

Preferably, two notches may be symmetrically arranged on the wall of the vaporizing tube, at an end close to the mouthpiece, the absorbent wick may be arranged in a U-shape and may be disposed on the notches, the heating coil may be wound around a part of the absorbent wick between the two notches of the vaporizing tube, and a part of the absorbent wick which is not wound by the heating coil may be attached on outer wall of the vaporizing tube, and the vaporization separating sleeve may cover the notches with only the absorbent wick extending out.

Preferably, the mouthpiece may be provided with a male connector, the housing may be provided with a female connector fitting with the male connector, and the mouthpiece and the housing may be connected with each other via the male connector and the female connector.

Preferably, a connecting end of the mouthpiece may be provided with two male snaps, the housing may be provided with a snap groove in which the male snaps can be accommodated and with which the male snaps can be rotatably, snapably and tightly fitted, and the mouthpiece and the housing may be connected by the tightly snap-fitting of the male snaps and the snap groove.

Preferably, the threaded connecting end may be provided with a center through hole, a tubular shaped vaporizing electrode may be sleeve-arranged in the center through hole and may have an end extending into the vaporizing tube, wherein the vaporizing tube may be a conductive metal tube, the heating coil may have one lead end electrically connected with the vaporizing electrode and another lead end electrically connected with the vaporizing tube, an isolating sleeve may be arranged between the vaporizing electrode and the threaded connecting end, and a sealing and isolating sleeve may be arranged between the vaporizing electrode and the vaporizing tube.

Preferably, a cigarette liquid sealing sleeve may be arranged between the outer sleeve, the inner sleeve and the threaded connecting end.

Preferably, a mouthpiece sealing sleeve may be arranged between the mouthpiece and the inner sleeve, wherein the mouthpiece sealing sleeve may be cup shaped, sleeved on one end of the inner sleeve, and provided with a vapor through hole arranged at the center of the cup bottom.

Preferably, a circular truncated cone which protrudes and has a decreasing outer diameter may be arranged at the cup bottom of the mouthpiece sealing sleeve, and a vapor through hole may be arranged at the center of the circular truncated cone.

Preferably, the housing and the outer sleeve may be integrally formed with a same material.

Advantages

In the case that the cigarette liquid is used up, when the mouthpiece is dismounted, the chamber body of the liquid storage chamber can be opened, thereby facilitating the replenishment of cigarette liquid and greatly facilitating the reuse of the electronic cigarette vaporizer by the user.

Figure 1:
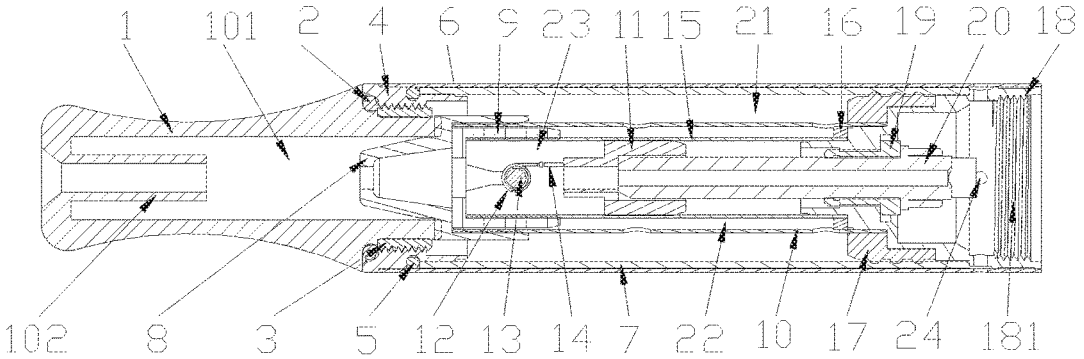
FIG. 1 is a central vertical sectional view of an electronic cigarette vaporizer according to a first embodiment of the present invention.

LIST OF REFERENCE NUMERALS OF MAIN COMPONENTS mouthpiece 1; vapor channel 101; mouthpiece inner tube 102; male snap 103; O-shaped sealing ring 2; male connector 3; female connector 4; O-shaped sealing ring 5; housing 6; window 61; outer sleeve 7; mouthpiece sealing sleeve 8; circular truncated cone 81; vaporization separating sleeve 9; inner sleeve 10; small hole 104; sealing and isolating sleeve 11; heating coil 12; absorbent wick 13; lead 14; vaporizing tube 15; notch 151; sealing ring 16; cigarette liquid sealing sleeve 17; threaded connecting end 18; internal thread 181; isolating sleeve 19; vaporizing electrode 20; liquid storage chamber 21; liquid guide path 22; vaporizing chamber 23; air inlet 24; snap groove connector 25.

DETAILED DESCRIPTION OF ILLUSTRATED EMBODIMENTS

The present invention will be further explained below in detail with reference to figures.

Figure 2:
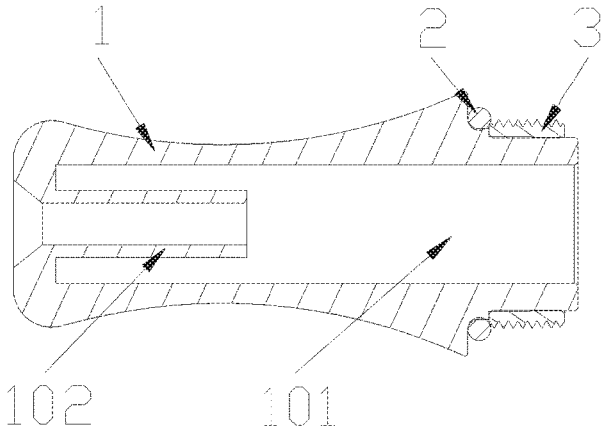
FIG. 2 is a central vertical sectional view of a mouthpiece according to the first embodiment of the present invention.
Figure 3:
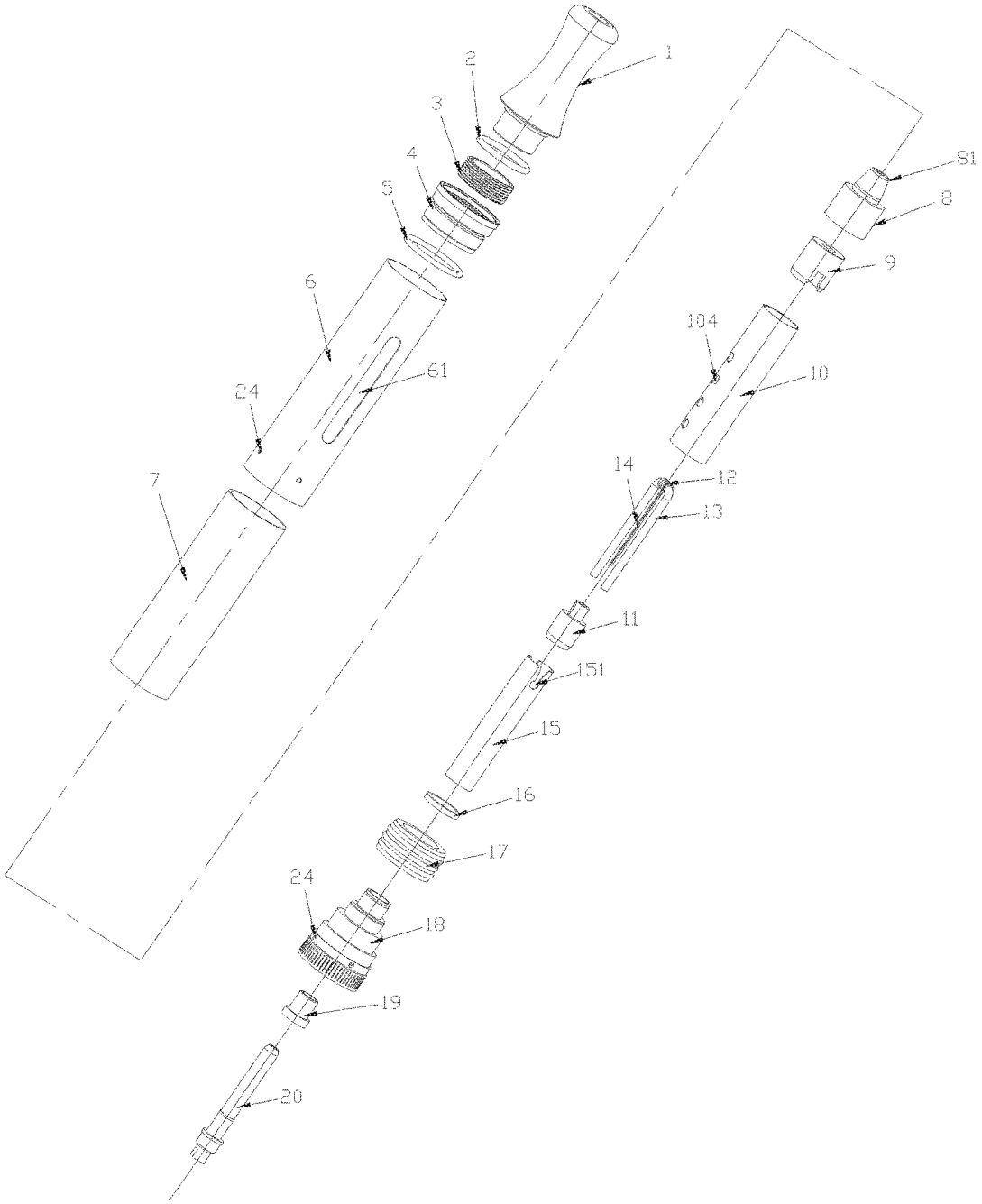
FIG. 3 is an exploded schematic drawing of the electronic cigarette vaporizer according to the first embodiment of the present invention.

FIGS. 1-3 illustrate a first embodiment of the present invention.

Referring to FIGS. 1 and 3, an electronic cigarette vaporizer according to the first embodiment of the present invention comprises a housing 6, and a dismountable mouthpiece 1 arranged at an end of the housing 6, wherein the mouthpiece 1 is provided with a vapor channel 101 through which the vapor passes, another end of the housing 6 is sleeved with a threaded connecting end 18, and the threaded connecting end 18 is provided with internal threads 181 so as to enable a connection with a battery (not shown in the figures) of the electronic cigarette, whereby the electronic cigarette vaporizer according to the present invention is connected with the battery to form a complete electronic cigarette.

As shown in FIGS. 1-3, the mouthpiece 1 has an outer diameter varying in a trumpet shape, which is ergonomic and facilitates comfortable use of the mouthpiece for mouth. One end of the mouthpiece 1, which is connected with the housing 6, is formed in a tubular shape with a reduced outer diameter. The tubular shaped outer wall is closely sleeved with a male connector 3, and inner walls of both the housing 6 and the outer sleeve 7 are closely sleeved with a female connector 4 which fits the male connector 3, such that the mouthpiece 1 and the housing 6 can be connected by threads and can be disconnected. Furthermore, an O-shaped sealing ring 2 is arranged at an upper portion of the male connector 3 of the mouthpiece 1 so as to avoid leakage of cigarette liquid through the threads, and an O-shaped sealing ring 5 is arranged at a joint of the female connector 4 and the housing 6 so as to avoid leakage of cigarette liquid through the joint therebetween. In addition, in a simply modification of the present embodiment, the male connector 3 and the mouthpiece 1 may be formed integrally, and the female connector 4 and the housing 6 may be integrally formed with a same material.

As shown in FIG. 2, a mouthpiece inner tube 102 is arranged at a suction port of the mouthpiece 1 and extends inwards, and a space between the mouthpiece inner tube 102 and an inner wall of the vapor channel of the mouthpiece form a concave cavity. During smoking, the vapor flows to the suction port through the vapor channel 101 of the mouthpiece 1, and some vapor forms a back flow in the concave cavity due to the mouthpiece inner tube 102 which has a smaller diameter. In this case, un-vaporized droplets of the vapor condense in the concave cavity, thereby effectively preventing un-vaporized cigarette liquid from entering into the user's mouth and improving user experience of smoking.

Referring to FIGS. 1 and 3, the outer sleeve 7 is closely sleeved in the housing 6, an inner sleeve 10 is axially arranged within the outer sleeve 7, a vaporizing tube 15 is axially arranged within the inner sleeve 10, and a vapor flow channel and vaporizing chamber 23 is arranged in the vaporizing tube 15. The vaporizing chamber 23 is in communication with the vapor channel 101 of the mouthpiece 1, and an absorbent wick 13 and a heating coil 12 wound around a part of the absorbent wick 13 are arranged in the vaporizing chamber 23. The outer sleeve 6, the inner sleeve 10 and the vaporizing tube 15 respectively have one end sealingly connected with the mouthpiece 1 and another end sealingly connected with the threaded connecting end 18, and a closed liquid storage chamber 21 for storing cigarette liquid is formed between the outer sleeve 7, the inner sleeve 10, the mouthpiece 1, and the threaded connecting end 18. Due to the configurations of the liquid storage chamber 21 and the mouthpiece 1, one end of the liquid storage chamber 21 can be opened when the mouthpiece 1 is dismounted. In this way, in the case that the cigarette liquid is used up, more cigarette liquid can be replenished into the liquid storage chamber 21 through the opened end of the liquid storage chamber 21 by the user, thereby allowing the electronic cigarette vaporizer to be reused.

In order to observe the amount of remaining cigarette liquid within the liquid storage chamber 21, the housing 6 in this embodiment is provided with an elongated window 61, and the outer sleeve 7 is made from a transparent material. In this way, the user is facilitated to observe the amount of remaining cigarette liquid within the liquid storage chamber 21 during smoking, and determine whether to add or replenish the cigarette liquid or not.

Referring to FIGS. 1 and 3, several small holes 104 are provided on the wall of the inner sleeve 10. A vaporization separating sleeve 9 is arranged between the inner sleeve 10 and the vaporizing tube 15, at an end near the mouthpiece 1. A sealing ring 16 is arranged at the other end. A closed liquid guide path 22 is formed between the inner sleeve 10, the vaporizing tube 15, the vaporization separating sleeve 9, and the sealing ring 16. Two notches 151 are symmetrically arranged on the wall of the vaporizing tube 15, at an end near the mouthpiece 1. The absorbent wick 13 is arranged in a U-shape and is disposed on the notches 151. The heating coil 12 is wound around the absorbent wick 13 between the two notches 151 of the vaporizing tube 15. Two ends of the absorbent wick 13, which are not wound by the heating coil 12, extend into the liquid guide path 22 and are attached on the outer wall of the vaporizing tube 15. The vaporization separating sleeve 9 covers the notches 151 and a part of the absorbent wick 13. Due to the above configurations of the present invention, the cigarette liquid of the electronic cigarette is throttled and flows into the liquid guide path 22 from the liquid storage chamber 21 via the small holes 104 provided on the wall of the inner sleeve 10, and the absorbent wick 13 with two ends extending into the liquid guide path 22 and being attached on the outer wall of the vaporizing tube 15 absorbs the cigarette liquid from the liquid guide path 22 and conducts it to the heating coil 12, so as to enable the cigarette liquid to be heated and vaporized. Due to the vaporization separating sleeve 9, the cigarette liquid is prevented from leaking to the vaporizing chamber 23 directly via the notches 151. Meanwhile, the vaporization separating sleeve 9 is tightly sleeved on the absorbent wick 13, so that the absorbent wick 13 is securely and tightly placed on the notches 151 of the vaporizing tube 15, thereby facilitating a stable and continued vaporizing effect. In addition, with the above configuration of the liquid guide path according to the present invention, during the refilling of the cigarette liquid by the user, the liquid guide path 22 will not be immediately filled with the cigarette liquid. In this case, since the mouthpiece closes the liquid storage chamber 21 when the user remounts the mouthpiece, the pressure inside the liquid storage chamber 21 is increased, thus the cigarette liquid is buffered and flows into the liquid guide path 22, and the air inside the liquid guide path 22 is discharged under pressure from the notches 151 of the vaporizing tube via the gaps of the absorbent wick 13, whereby the leakage of cigarette liquid during mounting of the mouthpiece is avoided.

In order to prevent the cigarette liquid inside the liquid storage chamber 21 from leaking through a joint of the mouthpiece 1 and the inner sleeve 10, a mouthpiece sealing sleeve 8 is arranged between the mouthpiece 1 and the inner sleeve 10. The mouthpiece sealing sleeve 8 is cup shaped and is sleeved on one end of the inner sleeve 10, and is provided with a vapor through hole arranged at the center of the cup bottom. In the present embodiment, a circular truncated cone 81 which protrudes and has a decreasing outer diameter is arranged at the cup bottom of the mouthpiece sealing sleeve 8. The vapor through hole is arranged at the center of the circular truncated cone 81. Outer wall of the circular truncated cone 81 and inner wall of the vapor channel 101 of the mouthpiece 1 are better sealingly connected with each other, thereby improving sealing effect. Moreover, the top of the circular truncated cone 81 is flushed with the end of the outer sleeve 7, so as to facilitate a smooth replenishment of e-cigarette liquid into the liquid storage chamber 21 when the mouthpiece 1 is dismounted, and meanwhile prevent the cigarette liquid from entering into the vaporizing chamber 23 accidentally.

Referring to FIGS. 1 and 3, the threaded connecting end 18 is closely connected with one end of the housing 6. The threaded connecting end 18 has a tubular shaped body with five-step reduced diameters. With the different outer diameters, it is simultaneously connected with the outer sleeve 7, the inner sleeve 10 and the vaporizing tube 15 as well as the housing 6. Furthermore, a cigarette liquid sealing sleeve 17 is arranged between the outer sleeve 7, the inner sleeve 10 and the threaded connecting end 18, so as to avoid leakage of cigarette liquid through the gaps therebetween.

In the present embodiment, since the threaded connecting end 18 is made of metal material and is conductive, it also serves as one of the electrodes electrically connected with the heating coil 12. The heating coil 12 is also electrically connected with another electrode, that is, a vaporizing electrode 20. Referring to FIGS. 1 and 3, the vaporizing electrode 20 is tubular shaped and is sleeve-arranged in a center through hole of the threaded connecting end 18. The vaporizing tube 15 is a conductive metal tube. The heating coil 12 has one lead end connected with the vaporizing electrode 20 and another lead end connected with the vaporizing tube 15. An isolating sleeve 19 is arranged between the vaporizing electrode 20 and the threaded connecting end 18. The vaporizing electrode 20 has one end extending into the vaporizing tube 15, and a sealing and isolating sleeve 11 is arranged between the vaporizing tube 15 and this end of the vaporizing electrode 20. In the present embodiment, the vaporizing electrode 20 is hollow tubular shaped, so as to allow air to pass through the vaporizing electrode 20 and enter into the vaporizing chamber 23. In this case, the vaporizing connecting end and the outer sleeve 7 are provided with an air inlet 24, so as to allow air to enter into the vaporizing electrode 20. The air inlet can also be provided on the battery, such that when the electronic cigarette vaporizer according to the present invention is connected with the battery, the air entered via the air inlet flows through the vaporizing connecting end 18 and then flows into the vaporizing electrode 20.

Embodiment of the Invention

Figure 4:
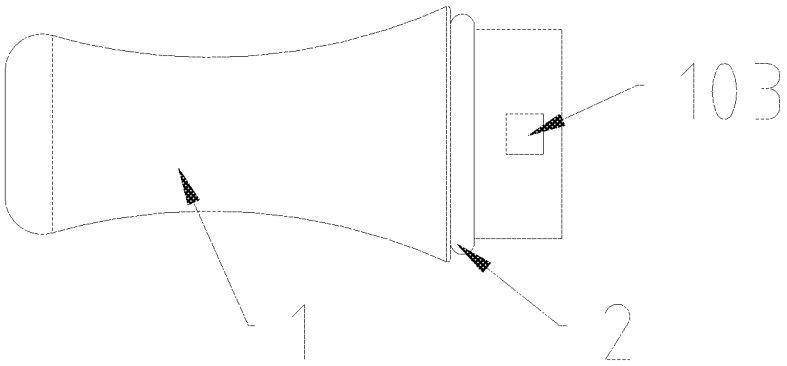
FIG. 4 is a front view of a mouthpiece according to a second embodiment of the present invention.
Figure 5:
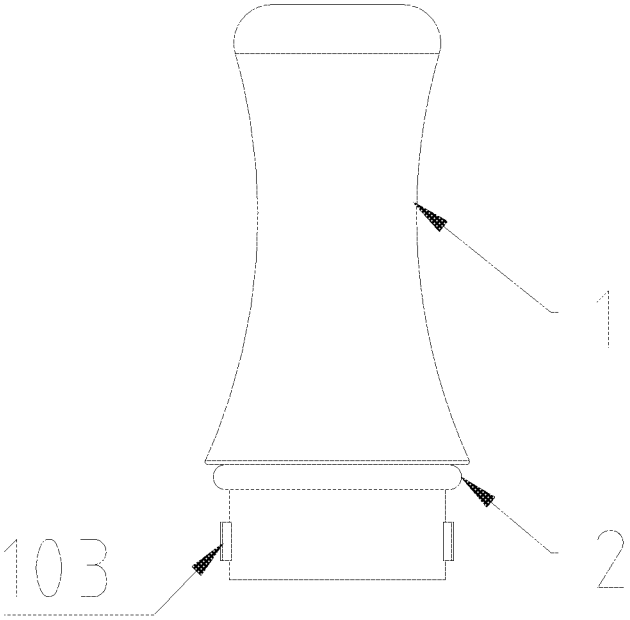
FIG. 5 is a schematic drawing of the mouthpiece according to the second embodiment of the present invention.
Figure 6:
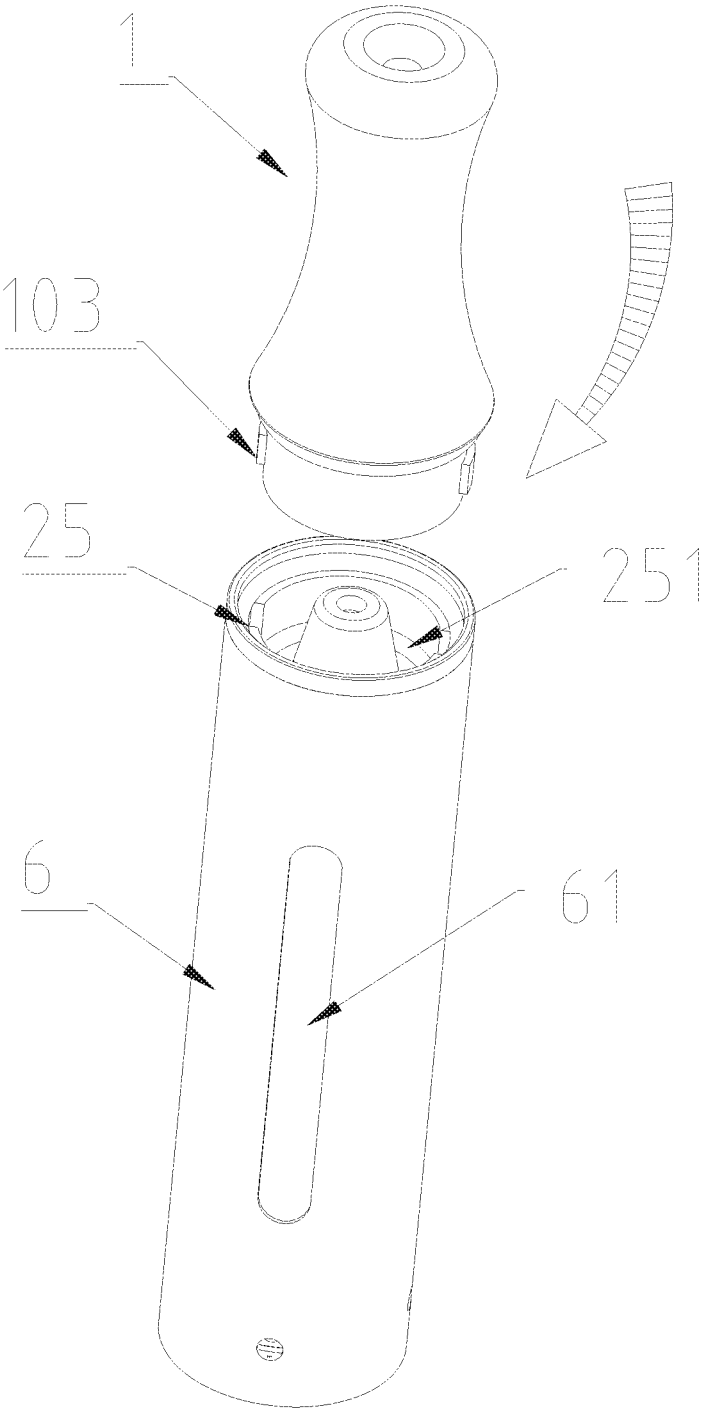
FIG. 6 is an exploded schematic drawing of the electronic cigarette vaporizer according to the second embodiment of the present invention.

FIGS. 4-6 illustrate a second embodiment of the present invention.

Referring to FIGS. 4-6, an electronic cigarette vaporizer according to the present invention differs from the first embodiment in that the mouthpiece 1 and the housing 6 are connected with each other by rotary snap fitting.

In the second embodiment, one end of the mouthpiece 1, which is connected with the housing 6, is formed in a tubular shape with a reduced outer diameter. Two male snaps 103 are symmetrically arranged on the outer wall of the tube. A snap groove connector 25 is closely sleeved inside the housing 6 and the inner wall of the outer sleeve 7 simultaneously. The snap groove connector 25 is provided with a snap groove 251, in which the male snaps 103 can be accommodated and with which the male snaps 103 can be rotatably, snapably and tightly fitted. In this case, the mouthpiece 1 and the housing 6 are connected by the tightly snap-fitting of the male snaps 103 and the snap groove 251. Due to the configuration of the present embodiment, the mouthpiece 1 and the housing 6 can be snap-fitted together and can be disassembled. Furthermore, an O-shaped sealing ring 2 is arranged at a tube-shaped upper portion of the mouthpiece 1 where the outer diameter is reduced, so as to avoid leakage of cigarette liquid.

INDUSTRIAL APPLICABILITY

All the above are merely the preferred embodiments of the present invention. The present invention is intended to cover all modifications and equivalent arrangements included within the principle and scope of the present invention according to the technical essence of the present invention.

The invention claimed is:

1. An electronic cigarette vaporizer, comprising a housing, a mouthpiece connected with an end of the housing and provided with a vapor channel, and a threaded connecting end sleeve-connected with another end of the housing, characterized in that: the mouthpiece is dismountably connected with the end of the housing, an outer sleeve is closely sleeved in the housing, an inner sleeve is arranged within the outer sleeve, a vaporizing tube is arranged within the inner sleeve, and a vapor flow channel and vaporizing chamber is arranged in the vaporizing tube, wherein the vaporizing chamber is in communication with the vapor channel of the mouthpiece, an absorbent wick and a heating coil wound around a part of the absorbent wick are arranged in the vaporizing chamber, the outer sleeve and the inner sleeve have one end sealingly connected with the mouthpiece and another end sealingly connected with the threaded connecting end, and a closed liquid storage chamber for storing cigarette liquid is formed between the outer sleeve, the inner sleeve, the mouthpiece, and the threaded connecting end, small holes are provided on a wall of the inner sleeve, a vaporization separating sleeve is arranged between the inner sleeve and the vaporizing tube at an end close to the mouthpiece, a sealing ring is arranged at another end, a closed liquid guide path is formed between the inner sleeve, the vaporizing tube, the vaporization separating sleeve, and the sealing ring, and a part of the absorbent wick which is not wound by the heating coil at least has an end extending into the liquid guide path.

2. The electronic cigarette vaporizer according to claim 1, characterized in that: the vaporization separating sleeve is cup shaped, is inversely and sleeve-arranged between the inner sleeve and the vaporizing tube, and a vapor through hole is arranged at a cup bottom of the vaporization separating sleeve.

3. The electronic cigarette vaporizer according to claim 1, characterized in that: two notches are symmetrically arranged on a wall of the vaporizing tube at an end close to the mouthpiece, the absorbent wick is arranged in a U-shape and is disposed on the notches, the heating coil is wound around a part of the absorbent wick between the two notches of the vaporizing tube, and a part of the absorbent wick which is not wound by the heating coil is attached on an outer wall of the vaporizing tube, and the vaporization separating sleeve covers the notches with only the absorbent wick extending out.

4. The electronic cigarette vaporizer according to claim 1, characterized in that: the mouthpiece is provided with a male connector, the housing is provided with a female connector fitting with the male connector, and the mouthpiece and the housing are connected with each other via the male connector and the female connector.

5. The electronic cigarette vaporizer according to claim 1, characterized in that: a connecting end of the mouthpiece is provided with two male snaps, the housing is provided with a snap groove in which the male snaps can be accommodated and with which the male snaps can be rotatably, snapably and tightly fitted, and the mouthpiece and the housing are connected by the tightly snap-fitting of the male snaps and the snap groove.

6. The electronic cigarette vaporizer according to claim 1, characterized in that: the threaded connecting end is provided with a center through hole, a tubular shaped vaporizing electrode is sleeve-arranged in the center through hole and has an end extending into the vaporizing tube, wherein the vaporizing tube is a conductive metal tube, the heating coil has one lead end electrically connected with the vaporizing electrode and another lead end electrically connected with the vaporizing tube, an isolating sleeve is arranged between the vaporizing electrode and the threaded connecting end, and a sealing and isolating sleeve is arranged between the vaporizing electrode and the vaporizing tube.

7. The electronic cigarette vaporizer according to claim 1, characterized in that: a cigarette liquid sealing sleeve is arranged between the outer sleeve, the inner sleeve and the threaded connecting end.

8. The electronic cigarette vaporizer according to claim 1, characterized in that: a mouthpiece sealing sleeve is arranged between the mouthpiece and the inner sleeve, wherein the mouthpiece sealing sleeve is cup shaped, sleeve-arranged on one end of the inner sleeve, and provided with a vapor through hole arranged at center of the cup bottom.

9. The electronic cigarette vaporizer according to claim 8, characterized in that: a circular truncated cone is arranged at the cup bottom of the mouthpiece sealing sleeve, the circular truncated cone protrudes and has a decreasing outer diameter, and a vapor through hole is arranged at center of the circular truncated cone.

10. The electronic cigarette vaporizer according to claim 1, characterized in that: the housing and the outer sleeve are integrally formed with a same material.

* * * * *